United States Patent [19]

Weinberg

[11] 4,324,046

[45] Apr. 13, 1982

[54] PATTERN GRADING DEVICE

[76] Inventor: Donald A. Weinberg, 2201 Acacia Park, Lyndhurst, Ohio 44124

[21] Appl. No.: 126,652

[22] Filed: Mar. 3, 1980

[51] Int. Cl.[3] ..... A41H 3/00

[52] U.S. Cl. ..... 33/17 A; 33/476

[58] Field of Search ..... 33/11, 17 A, 429, 474, 33/476

[56] References Cited

U.S. PATENT DOCUMENTS

| | | | |
|---|---|---|---|
| 22,585 | 1/1859 | Ripley | 33/429 |
| 2,026,274 | 12/1935 | Doyle | 33/429 |
| 2,813,341 | 11/1957 | DiMino | 33/17 A |
| 3,367,029 | 2/1968 | Lee | 33/17 A |

*Primary Examiner*—Charles E. Phillips

*Attorney, Agent, or Firm*—Meyer, Tilberry & Body

[57] ABSTRACT

Master garment patterns are copied while altering the size through the use of a grading device and method of using the same. The grading device has an elongated major axis with parallel spaced indicia therealong, and a pair of minor axes each perpendicular to the major axis with parallel spaced indicia along both. By securing the grading device relative to a copy material, the master pattern is duplicated at an increased or decreased size by moving the pattern along a defined path relative to the device. Movement of the master pattern occurs while maintaining a preselected two dimensional orientation of the pattern respectively parallel to the two dimensional indicia on the device.

1 Claim, 5 Drawing Figures

FIG. 1
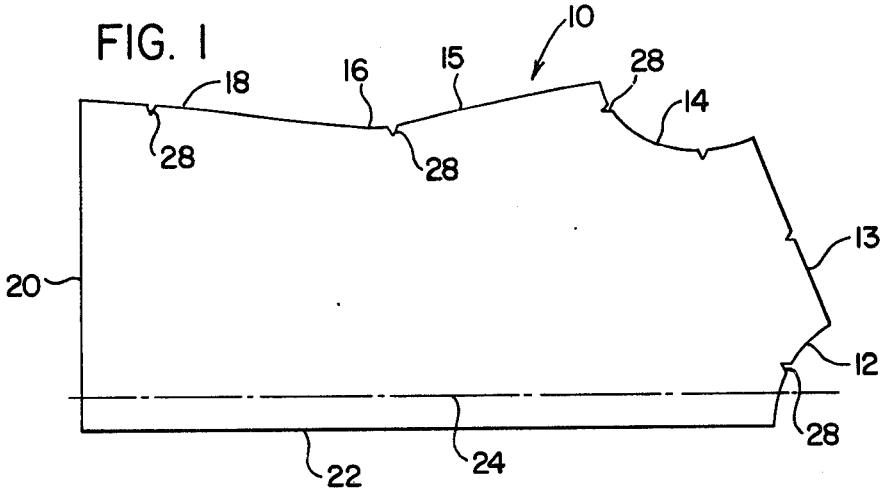
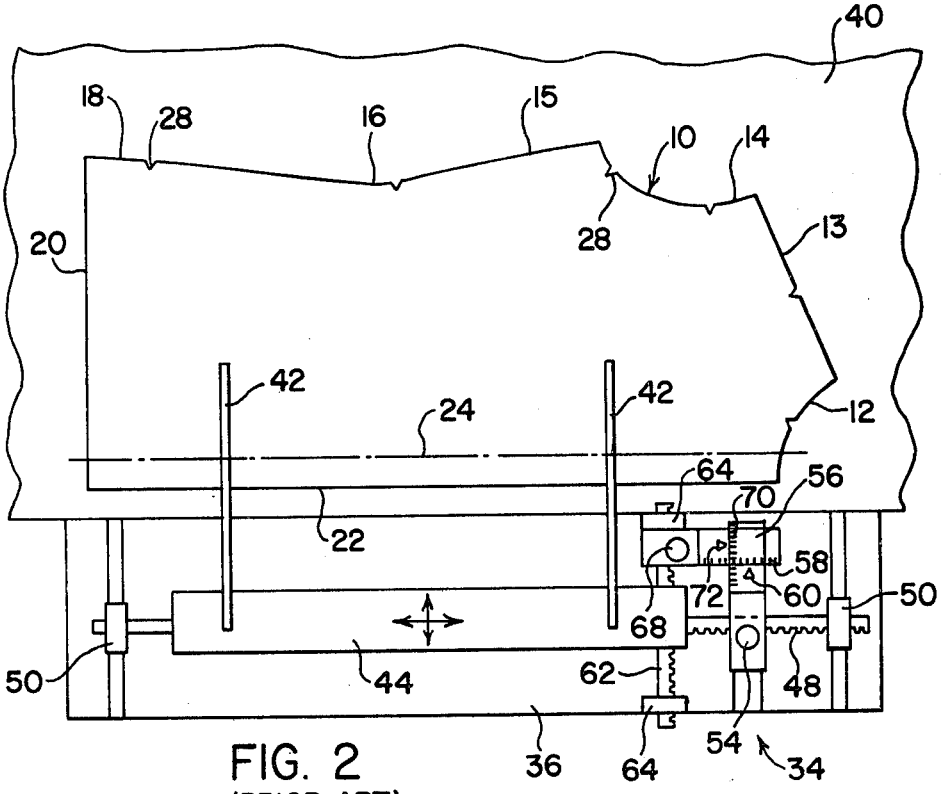
FIG. 2
(PRIOR ART)

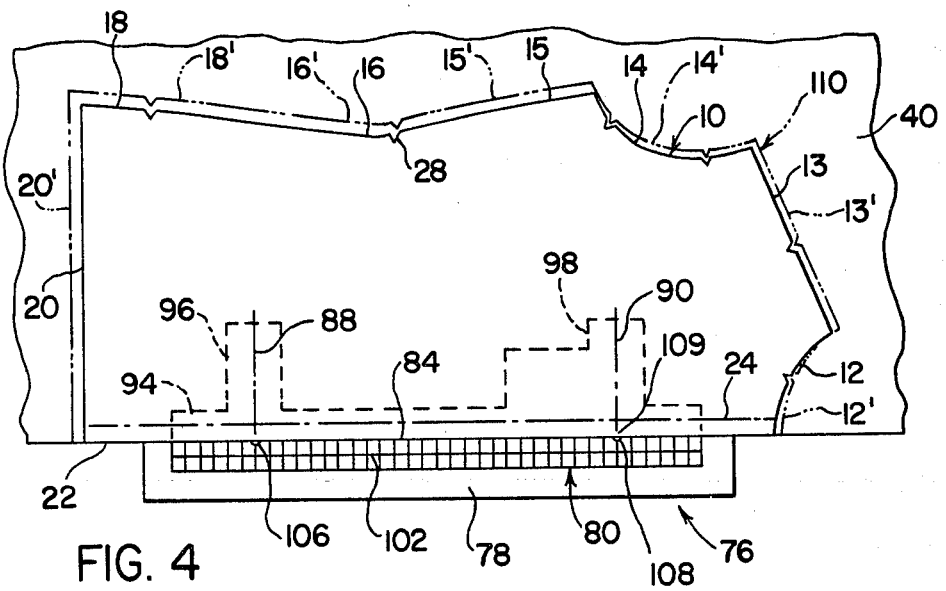
FIG. 4
FIG. 5
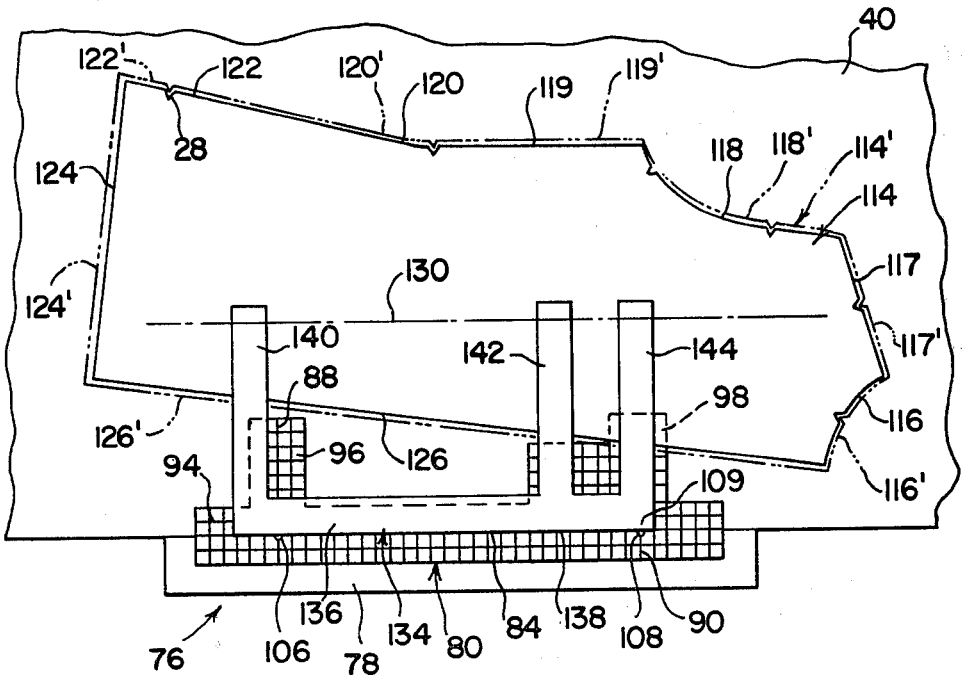

PATTERN GRADING DEVICE

BACKGROUND OF THE INVENTION

The present invention is related to grading of master patterns resulting in a duplication of the outline of the pattern at an increased or decreased size. More specifically, patterns used for the production of garments are graded to provide up-sizing and down-sizing of the master pattern as required for a particular use. It should be expressly understood however, that the method and device of the present invention are useful, and may be used, for the grading of any pattern regardless of the material of which the pattern or copy material is constructed, or the use to which either is to be put.

Generally, a master pattern for any particular style of garment is constructed with dimensions corresponding to one specific size of the garment. More particularly, for each grouping of garment, such as; womens, juniors, or petites, the master patterns are generally available only in one size. For example, master patterns for womens garments are available in size 10, while juniors are size 9 and petite are size 8. In order to provide clothing in all sizes required by the consuming public, grading of the master patterns to both larger and smaller sizes is required. While the range of sizes for any particular garment is relatively broad, the master pattern is generally provided at a size nearer the bottom of the range. For example, womens sizes range from 4 to 20, while the master pattern is a size 10. Likewise, junior sizes range from 5 to 17 and petites from 4 to 14. In order to accomodate the entire range of sizes, the original pattern must be duplicated, in contour, while changing the area between the smallest and largest sizes.

Grading a master pattern to alter the size is not necessarily a simple matter of linearly increasing the outline or contour. Increasing or decreasing the length of the garment a specific dimension does not necessarily result in a corresponding increase or decrease, respectively, of the neck opening or arm opening, for instance. As a result, grading of patterns requires a considerable amount of knowledge and judgment on the part of an operator of any device which might be used for grading the patterns.

Initially, an operator intending to grade a pattern be either up-sizing or down-sizing positioned a master pattern on a portion of copy material and caused the master pattern to move along a two dimensional path on the surface of the copy material in accordance with rules of grading. The path along which the pattern moved was established by the outline of the pattern and a standard ruler calibrated in sixteenths of an inch. Rules of grading involved in up-sizing from 10 to 12 include for instance: moving the neckline and shoulder out 1/16 inch and over 3/32 inch; the shoulder and arm out $\frac{1}{4}$ inch and over 3/32 inch; the arm and side out $\frac{5}{8}$ inch and over 7/32 inch; the waist out $\frac{5}{8}$ inch and over 11/32 inch; and, the length out $\frac{5}{8}$ inch and over 15/32 inch. Use of a standard ruler for grading the patterns presented disadvantages in maintaining the starting point of the path, maintaining the orientation of the pattern with respect to the copy material and providing the appropriate dimensional changes at each critical point of change.

Over the years a number of devices have been devised for assistance in grading patterns. Regardless of the device used for grading, the experience in judgment of an operator in providing the degree in increase or decrease for each critical point on the pattern has been required. Prior art devices removably secure a master pattern relative to a portion of the device while a copy material is maintained in position with respect to the device. The device secures the master pattern in a manner allowing for movement of the pattern relative to the copy material and a base of the device in two perpendicular directions. Movement of the master pattern is accomplished by any suitable means, such as a rack and pinion mechanism mounted on the base of the device. A scale positioned relative to each of the two perpendicular directions of movement indicates the extent of movement of the master pattern from a central or zero position.

In grading a master pattern, the operator provides the expertise and judgment, as before, in determining the degree of movement in each direction for each critical point of the pattern. Movement of the master pattern along a preselected path is accomplished by manually adjusting mechanical movement means in each of the two directions. While these devices provide a substantial improvement over the prior method of using a standard ruler, the judgment of the operator and physical adjustment of the movement means are still required. Additionally, these devices are extremely expensive for the amount of hardware provided, for example: $600-325 per unit. Examples of grading devices in the prior art are units manufactured under the names of Dario and Sunny-Young Inc.

Still a more recent attempt to develop an improved grading device involves a two dimensional ruler such as that marketed by Rick Offredo. This grading device is fixed relative to a work surface and copy material, while a master pattern is moved along a preselected grading path relative to the device. While this two dimensional ruler must be kept small in size to avoid interference with the grading of the master pattern, the resultant small size is disadvantageous due to maintenance of orientation of the master pattern relative to the device and limitation of movement in the two dimensions.

SUMMARY OF THE INVENTION

The present invention provides an improved grading device for up-sizing and down-sizing patterns, particularly master patterns as customarily used in the garment industry.

In accordance with a preferred embodiment of the invention, the device of the present invention includes a two dimensional ruler or gauge means having a major axis and two minor axes perpendicular to and spaced an appreciable distance apart along the major axis. One dimension of the ruler is provided along the major axis while the other dimension is provided along the minor axes. The device is positioned stationary relative to a copy material onto which the pattern is to be graded, while the master pattern is moved relative to the device and the copy material. A two dimensional orientation is selected, relative to the pattern, and maintained parallel to the respective two dimensions of the grading device while the master pattern is moved along a preselected path corresponding to the outline of the pattern. The device is extremely simple to operate and is essentially maintenance free since there are no moving parts involved.

The primary object of the present invention is the provision of a pattern grading device which is inexpensive to manufacture and does not require maintenance.

Another object of the present invention is the provision of a pattern grading device which readily enables reconstruction of a starting point of the grading; and, which maintains a preselected two dimensional orientation of the pattern parallel to a respective two dimensional orientation of the grading device.

In accordance with another preferred embodiment of the present invention, master patterns which have continuously deviating outlines are capable of being graded despite the lack of a straight edge to align with the grading device. A guide member is secured to the master pattern such that a straight edge of the guide member is completely exterior to the outline of the master pattern. The straight edge of the guide member is used to select a two dimensional orientation of the pattern which is maintained parallel relative to the grading device.

Still a further object of the present invention is the provision of a pattern grading device which enables a master pattern having a completely deviated outline to be accurately graded.

BRIEF DESCRIPTION OF THE DRAWINGS

The invention may take physical form in a variety of parts and arrangements of parts, preferred embodiments of which will be described in the following specification and are illustrated in the accompanying drawings which form a part hereof and wherein:

FIG. 1 is a plan view of one variety of master pattern capable of grading through use of the present invention;

FIG. 2 is a plan view illustrating one prior art pattern grading device with a master pattern and copy material operatively disposed;

FIG. 4 is a plan view of the pattern grading device of the present invention in operative relation with a master pattern and copy material; and, FIG. 5 is a plan view illustrating the pattern grading device of the present invention in operative relation with a totally deviating contoured master pattern and copy material.

DETAILED DESCRIPTION OF THE PREFERRED EMBODIMENTS

Figure 3:
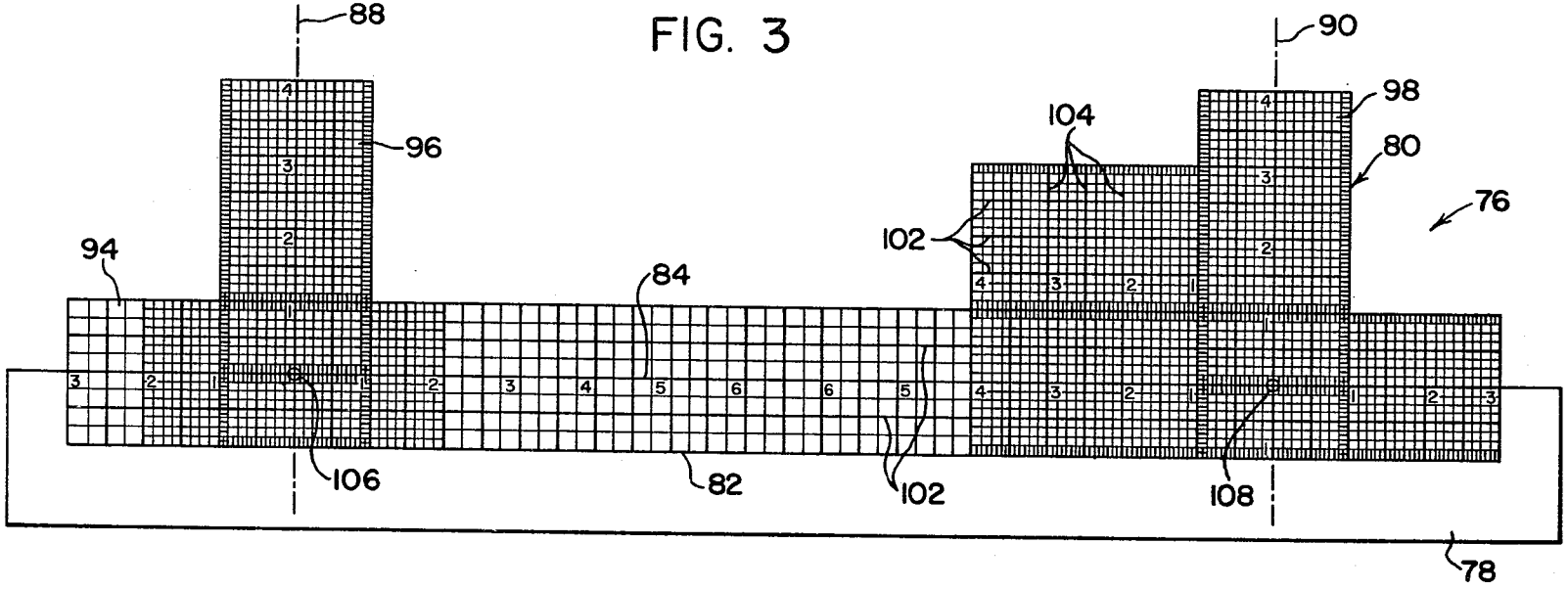
FIG. 3 is a plan view illustrating the pattern grading device of the present invention.

Referring now to the drawings wherein the showings are for the purpose of illustrating preferred embodiments of the invention only and not for the purpose of limiting the invention, FIG. 1 illustrates a master pattern 10 which is required to be graded to up-size or down-size for a particular use. Although master pattern 10 is illustrated as a portion of a pattern for a garment, item of clothing, or wearing apparel and this discussion is limited to garment patterns, the principles of the invention are equally applicable for grading of any variety, type or construction of pattern. Master pattern 10 conveniently represents the front portion of a garment such as a dress or blouse and includes a neck section 12, a shoulder section 13, an arm section 14, a side section 15, a waist section 16, a length section 18 and a bottom section 20. A seam or center 22 connects one end of neck section 12 to one end of bottom section 20 and, in the case of pattern 10, comprises a straight line. It should be readily understandable that two portions of material corresponding to master pattern 10 are sewn together at seam 22 to form a complete front of a garment such as the dress or blouse. The two portions of material, cut in accordance with master pattern 10, are sewn at seam 22 along a grain line 24 which is parallel to seam 22.

In the manufacture of a garment such as contemplated by master pattern 10, a collar portion is attached at neck section 12 while an arm portion is attached at arm section 14. Shoulder 13, side 15, waist 16 and length 18 are attached to corresponding sections of a back portion of the garment, as by sewing. For purposes of attaching these additional garment portions and enabling the garment fabric to lay smoothly at the resulting seams, the garment sections of master pattern 10 are provided with sewing notches 28 at critical areas along the outline of the pattern.

As noted above, master patterns are generally provided to a manufacturer of garments in one specific size for a particular group of garments. Thus, while master pattern 10 is equivalent to size 10 in a womens garment, the manufacturer of garments is required to produce garments of the identical style provided by the pattern in a variety of sizes ranging from 4 to 20. As a result, the manufacturer of the garment of any particular size other then size 10 is required to up-size or down-size master pattern 10 appropriately, by grading the master pattern. Further as noted above, the procedures for grading a particular pattern do not contemplate an equivalent increase or decrease of dimensions at the entire outline of the pattern. As for example, while an increase in size of a garment requires a longer length section 18 of a given degree, the waist, arm, shoulder and neck are not necessarily increased by the same degree. In this respect, a certain amount of experience and expertise on the part of a craftsman in grading the pattern is necessary to adjust for differences and degree of extension or reduction at various critical points along the outline of the pattern.

While pattern grading was originally accomplished by means of a standard ruler, the work of the craftsman in grading the pattern was simplified through the use of a grading device 34 that includes a base structure 36 which during use is rendered immobile relative to an underlying work surface such as by clamping members (not shown). A portion of copy material 40 is positioned adjacent to base 36 of the grading device and may likewise be rendered stationary relative to the work surface and grading device 34 by any suitable means.

Grading device 34 includes a pair of gripping members 42 extending over the copy material from a frame member 44 mounted on base 36. Gripping members 42 each comprise two immediately adjacent pre-bent spring steel members arranged to clamp master pattern 10 therebetween in overlying relationship with copy material 40. Frame member 44 preferably allows for adjustment of the distance between gripping members 42 for the purpose of supporting and gripping patterns having a variety of dimensions.

The frame member is rendered longitudinally movable (right to left as viewed in FIG. 2) relative to base 36 of the grading device by any suitable means such as a rack 48 extending from the frame member and mounted on base 36 by supports 50. Movement of frame member 44 and thus gripping members 42 with master pattern 10 clamped therein occurs as a result of adjustment of a first control knob 54 connected to a pinion gear (not shown) engaging rack 48. First control knob 54 is located on a panel structure 56 which includes a scale 58 registering 1/16 of an inch movements of frame member 44 relative to the base. A pointer 60 indicates the location of frame member 44 relative to base 36.

In a like manner, frame member 44 is transversely movable (top to bottom as viewed in FIG. 2) relative to base structure 36 as a result of a rack 62 extending from the frame member and mounted on the base structure by supports 64. Transverse movement of the frame member and thus pattern 10 is obtained by manual adjustment of a second control knob 68 connected to a pinion gear (not shown) engaging rack 62. As in the case of first control knob 54, second control knob 68 is located on panel structure 56 which includes a scale 70 registering 1/16 of an inch movements of the frame member transverse to base structure 36. A pointer 72 indicates the position of frame member 44 transversely relative to the base structure.

Once master pattern 10 is secured by gripping members 42 of the grading device, grading of the master pattern is accomplished as noted above. Master pattern 10 is moved along a predetermined path in accordance with the degree of up-sizing or down-sizing required by successive adjustment of first and second control knobs 54 and 68.

A grading device 76, in accordance with the present invention, is shown in FIG. 3 wherein the device includes a base structure 78 and a scale structure 80 permanently secured together in a parallel relationship. Both base structure 78 and scale structure 80 are preferably constructed of a polymeric or acrylic material such as polystyrene, polyethylene, or polyvinyl chloride and are secured to one another as by gluing or otherwise bonding the plastic materials. Scale structure 80 overlies base structure 78 such that a bottom straight edge 82 of the scale structure is parallel to a long axis of the generally rectangular base structure. The polymeric or acrylic material of which structure 80 is constructed is preferably clear.

Scale structure 80 includes a major axis 84 parallel to straight edge 82 and thus base structure 78. Two minor axes 88 and 90 are parallel to one another and perpendicular to major axis 84. Scale structure 80 includes a longitudinal portion 94 generally parallel to major axis 84 and having a lateral side portion projecting laterally beyond an underlying longitudinal side edge of the base structure 78 to thereby provide a relief space under the projecting lateral side portion for the accommodation therein of pattern copy material. Scale structure 80 further includes a lateral arm portion 96 generally parallel to minor axis 88 and a second lateral arm portion 98 generally parallel to minor axis 90. Second lateral portion 98 is preferably larger than first lateral portion 96 for reasons to be explained further hereinbelow. The surface of scale structure 80 includes first and second series of lines or indicia 102 and 104, each separately arranged in parallel along major axis 84 and minor axes 88 and 90, respectively, so that the lines 102 and 104 are orthogonally disposed relative to one another. The indicia are preferably spaced over the majority of scale structure 80 one-eighth of an inch apart. At relatively unused portions of the scale, the indicia may be one-quarter inch apart, as for example in the area between lateral portions 96 and 98 and the extreme left end of the scale. Major axis 84 and minor axes 88 and 90 preferably have markings at corresponding intersections indicating inches. And, at relatively frequently used portions of scale structure 80, it may be desirable to have the major and minor axes marked in one-sixteenth of an inch intervals. Thus, as shown in FIG. 3, these one-sixteenth inch indicia markings are desirably provided at least along the side edges of the lateral arm portions 96, 98 of scale structure 80, along the end edges of these lateral arm portions which coincide with the bottom straight edge 82 of the scale structure portion 94, and along linear extents of the scale structure portion 94 which are at least coextensive with the width of the lateral arm portions 96, 98 and which extend parallel to and respectively coincide with the major axis 84 and with the top and bottom longitudinal straight edges of scale structure portion 94.

These indicia are preferably provided on the surface of scale portion 80 by any convenient method of printing or embossing in a clearly distinguishable color, such as red. The intersections of major axis 84 with minor axes 88 and 90 are conveniently provided with one accurately overlying indicia each and are distinctively marked as at 106 and 108 respectively with a zero or dot.

Grading device 76 is used to provide sizing of master pattern 10 as shown in FIG. 4 by inserting copy material 40 beneath and into the relief space between the scale structure 80 and the work surface on which the copy material 40 and grading device 76 are rested, and positioning the copy material 40 with a straight edge thereof in abutment with the top longitudinal edge of the base structure 78 which underlies the longitudinal portion 94 of the scale structure 80. Master pattern 10 is positioned in overlying relationship to scale 80 and the copy material. Throughout the movements required in grading the pattern, grain line 24 of the master pattern is required to be kept parallel to first indicia 102. As a result of the first indicia 102 including a multitude of parallel lines extending parallel to straight edge 82 of longitudinal portion 94 and across both lateral portions 96 and 98, the required parallel relationship is easily maintained by aligning grain line 24 with one of first indicia 102.

To initiate grading of master pattern 10 a point 109 along grain line 24 is selected and aligned with the intersection of major axis 84 and minor axis 90. By marking this starting point of master pattern 10, the start of the graded pattern to be constructed may be reconstructed at any time required by repositioning the point at the intersection of the axes.

A graded pattern 110, indicated in phantom lines in FIG. 4, is constructed or outlined on the copy material 40 in accordance with the movements and rules as indicated above. Assuming that graded pattern 110 is to be a size 12 womens, while master pattern 10 is a size 10 womens, construction of the graded pattern is as follows: Starting with the seam 22 of the master pattern 10 parallel with and immediately adjacent to major axis 84 and point 109 at the intersection of the major axis and minor axis 90, pattern 10 is moved longitudinally to the right 3/32 of an inch ($\frac{3}{4}$ indicia 104) and transversely up 1/16 of an inch ($\frac{1}{2}$ indicia 102) where altered neck section 12' and shoulder 13' are traced onto the copy material 40; pattern 10 is moved transversely away or up from the grading device 3/16 of an inch ($1\frac{1}{2}$ indicia 102) while maintaining grain line 24 parallel to the major axis and first indicia 102 where altered arm section 14' and shoulder 13' are traced; pattern 10 is moved to the left $\frac{1}{8}$ of an inch (1 indicia 104) and away from the grading device $\frac{3}{8}$ of an inch (3 indicia 102) where altered arm 14' and side 15' are traced; pattern 10 is moved to the left $\frac{1}{8}$ of an inch (1 indicia 104) where altered waist section 16' and bottom 20' are traced; pattern 10 is moved to the left $\frac{1}{8}$ of an inch (1 indicia 104) where altered length 18' is traced; and pattern is moved toward the grading device until seam 22 is immediately adjacent to, and parallel with, major axis 84 where altered bottom 20' and the seam are traced. At each critical point corresponding to the intersection of the neck to shoulder, shoulder to arm, arm to side, side to waist, waist to length, and length to bottom, the traced lines are required to be blended manually. While pattern 10 is moved along the predetermined path depending upon the particular degree of grading desired, sewing notches 28 are also traced.

The above explanation of the use of grading device 76 is undertaken with master pattern 10 having at least one substantially straight edge such as seam 22. However, device 76 is easily adaptable for grading patterns having no exterior straight edge. A master pattern 114 without such a straight exterior edge is shown in FIG. 5 in conjunction with grading device 76. Pattern 114 corresponds to one of two back portions for a dress wherein a neck section 116 connects to a shoulder section 117, which connects to an arm section 118, which connects to a side 119, which connects to a waist section 120, which connects to a length section 122, which connects to a bottom section 124 which in turn connects to a seam or zipper section 126, and returns to neck section 116. Pattern 114 includes a grain line 130 which is not, in this case, parallel to any exterior contour.

In order to grade pattern 114 with the aid of grading device 76, a guide frame 134 is secured to the pattern and correspondingly moved relative to grading device 76. Guide frame 134 includes a base structure 136 presenting a straight exterior edge 138 and three parallel, transversely extending arms 140, 142 and 144. Arms 140 and 144 are arranged to be relatively removed from one another, while arm 142 is relatively close to arm 144 for reasons to be further explained hereinbelow. Guide frame 134 is secured to pattern 114 by any suitable means, such as tape, such that each of the equal length arms 140 through 144 are correspondingly equally positioned relative to grain line 130. In this respect, edge 138 of the guide frame is parallel to grain line 130 and thus may be used in the grading of pattern 114. Using edge 138 and point 109, as described above with reference to pattern 10, graded pattern 114' is constructed involving either up-sizing or down-sizing as desired, by moving pattern 114 with guide frame 134 along a predefined path relative to the grading device.

Patterns 10 and 114 by no means represent all possible configurations of patterns and, in particular, relatively small patterns may require grading. Such relatively small patterns may correspond to, for example: collars, arms, and other portions of a garment. Generally, these portions of a garment would not be expected to have a contour presenting a substantially straight edge to be used with the grading device as shown in FIG. 4. For this reason, grading of such a pattern portion would be accomplished through use of guide frame 134 wherein the pattern is removably secured to arms 142 and 144 which are specifically located close together to accommodate such pattern portions. Regardless of the shape of the particular pattern or pattern portion being graded, the predetermined path along which the pattern would move relative to grading device 76 is determined in an identical manner.

While the descriptions herein have been specifically directed to increasing a size 10 pattern to a size 12, it may easily be seen that transformation from the original master pattern to any desired size may be easily accomplished through the use of grading device 76. In this respect, if a size 18 were desired to be graded from the women's dress master pattern 10 shown in FIG. 1, each particular movement described in FIG. 4 would be multiplied by 4 as a result of the four garment sizes encountered in upgrading from a 10 to an 18 (12, 14, 16 and 18) e.g. right 3 indicia 104 and up 2 indicia 102, etc. Likewise, decreasing the size of a particular pattern is accomplished by moving the pattern along a path defined by the movements described in FIG. 4 in opposite directions, e.g. left $\frac{3}{4}$ indicia 104 and down $\frac{1}{2}$ indicia 102, etc. for a size 8. The device is equally capable of grading half-size master patterns to greater or lesser half sizes.

The presence of two minor axes 88 and 90 on grading device 76 assures that alignment with second indicia 104 may be accurately made along the entire length of the pattern being graded. Further, the relative sizes of first lateral portion 96 and second lateral portion 98 of scale structure 80 correspond to the majority of movements of the pattern along its predetermined path being measured from the intersection of the major axis 84 and minor axis 90.

While considerable emphasis has been placed herein on preferred embodiments of the invention and the specific structures and structural interrelationships of the component parts thereof, it will be readily apparent that many embodiments of the invention can be made, and that many changes can be made in the embodiments herein illustrated and described without departing from the principles of the invention. Accordingly, it is to be distinctly understood that the foregoing descriptive matter is to be interpreted as merely illustrative of the invention and not as a limitation.

What is claimed is:

1. A grading device for grading a master pattern having a predefined outline, comprising: an elongated base member for resting flatwise on a flat work surface and having at least one longitudinal side edge, an elongated scale member secured flatwise to the top surface of said base member in longitudinally parallel overlying relation thereto, said scale member having a longitudinal major axis parallel to and coinciding with the said longitudinal side edge of said base member, said elongated scale member further including at least a pair of lateral arm portions projecting laterally outward relative thereto and to the said one longitudinal side edge of said base member and extending in parallel relation to each other, said lateral arm portions being spaced an appreciable distance apart along the length of said scale member and having respective minor parallel axes perpendicular to said major axis, said scale member being provided with indicia lines disposed orthogonally on the said lateral arm portions thereof and on at least the portions of said scale member between the said lateral arm portions, said indicia lines respectively extending parallel and perpendicular to the said major axis of said scale member, said grading device further including a guide frame for attachment to a master pattern and resting on the said scale portion of said grading device for sliding adjustment movement relative thereto, said guide frame comprising an elongated base portion having a longitudinal straight side edge and three parallel pattern-holding arms projecting laterally outward from the other longitudinal side edge of said base portion, two of said arms being spaced an appreciable distance apart along the length of said base portion and the third one of said arms being in relatively close spaced relation to one of said two arms.

* * * * *